US005826286A

United States Patent [19]

Cranston

[11] Patent Number: 5,826,286

[45] Date of Patent: Oct. 27, 1998

[54] VETERINARY SURGICAL TABLE

[75] Inventor: Dale Cranston, Baldwin, Kans.

[73] Assignee: VSSI, Inc.

[21] Appl. No.: 727,914

[22] Filed: Oct. 9, 1996

[51] Int. Cl.[6] ..... A61G 13/04; A61G 13/06; A61G 13/08; A61G 13/02

[52] U.S. Cl. ..... 5/606; 5/610; 5/613; 5/942; 108/2; 108/26; 269/15

[58] Field of Search ..... 5/606, 610, 614, 5/613, 942; 108/2, 26; 269/15; 119/722, 723, 724, 753

[56] References Cited

U.S. PATENT DOCUMENTS

| | | | |
|---|---|---|---|
| 673,675 | 5/1901 | Bernstein . | |
| 684,131 | 10/1901 | Taubert et al. . | |
| 859,696 | 7/1907 | Schmidt | 119/753 |
| 1,346,586 | 7/1920 | Barber | 119/753 |
| 1,822,206 | 9/1931 | Ferguson | 5/606 |
| 1,919,908 | 7/1933 | Schmidt et al. | 5/606 |
| 3,089,642 | 5/1963 | Blomqvist | 5/610 |
| 3,093,836 | 6/1963 | Christensen et al. | 5/606 |
| 3,281,141 | 10/1966 | Smiley et al. | 5/614 |
| 3,328,024 | 6/1967 | Weil | 5/606 |
| 3,444,830 | 5/1969 | Doetsch | 102/2 |
| 3,520,529 | 7/1970 | Obel | 119/753 |
| 3,615,088 | 10/1971 | Compton | 119/753 |
| 3,806,109 | 4/1974 | Weber et al. | 5/610 |
| 4,023,849 | 5/1977 | Bethlen | 5/610 |
| 4,195,829 | 4/1980 | Reser . | |
| 4,225,988 | 10/1980 | Cary et al. | 5/942 |
| 4,558,847 | 12/1985 | Coates | 5/611 |
| 5,224,228 | 7/1993 | Larrimore | 5/942 |
| 5,303,437 | 4/1994 | Hung | 5/613 |
| 5,546,852 | 8/1996 | Bidwell | 269/15 |

FOREIGN PATENT DOCUMENTS

| | | | |
|---|---|---|---|
| 166202 | 12/1933 | Switzerland | 5/606 |

OTHER PUBLICATIONS

Cover page pp. H2 through H11 of Shor–line Catalog published in May 1995.

Cover page and pp. 45 through 50 and back page of catalog by Suburban Surgical Company, Inc. showing surgical tables applicant acknowledges as prior art.

*Primary Examiner*—Alexander Grosz

*Attorney, Agent, or Firm*—Hovey, Williams, Timmons & Collins

[57] ABSTRACT

A veterinary surgical table is provided which includes a top animal-supporting surface mounted for inclining and supported by at least one extensible rod which provides counterbalancing support for the weight of the top surface and an animal placed thereon. The top surface is preferably longitudinally bifurcated into two pivotally mounted sections to provide independent tilting of each section toward one another, each section being separately counterbalanced by an extensible rod for such tilting movement. The top surface is preferably supported by the extensible rods in strut-supported configuration for minimizing the framework for supporting the table. A slidably removable tray is mounted beneath the separation between the sections for receiving fluid runoff and for enhanced cleaning and sanitation.

18 Claims, 4 Drawing Sheets

VETERINARY SURGICAL TABLE

BACKGROUND OF THE INVENTION

1. Field of the Invention

This invention concerns a veterinary surgical table including counterbalancing members for offsetting the weight of the animal during inclining or tilting of the table. More particularly, it is addressed to a veterinary surgical table employing counterbalancing cylinders which may be individually actuated to position the supporting surface of the table in any one of a variety of positions.

2. Description of the Prior Art

Veterinary surgical tables as used herein are used to support dogs, cats and other small animals during examination or surgery. It is desirable to elevate the animal to facilitate the veterinarian's work in an upright position. To this end, it may be desirable to incline or tilt the top of the table along one or more axes so that the animal is properly oriented, to maintain the position of the animal, or to facilitate the runoff of fluids.

Various methods of inclining the table are known, and these include racks which support the surface when it is manually raised, as shown in U.S. Pat. No. 673,675. U.S. Pat. No. 3,520,529 to Obel uses large power driven hydraulic cylinders to lift the surface on which horses or other large domestic animals are supported. Another device is shown in U.S. Pat. No. 3,615,088 wherein an inclinable surface is maintained in position by the use of clamps engaged with rods which support the top of the table in an inclined orientation.

While maintaining the surgical table top in an inclined orientation, these mechanisms have been either physically taxing on the veterinarian or expensive to construct. Further, when the surgical table is longitudinally bifurcated, collection of the fluid and cleaning of the table tops have presented a problem, as well as counterbalancing each side of the bifurcated top.

There has thus developed a need for a veterinary surgical table which is inexpensive to construct but aids the veterinarian by at least partially counterbalancing the weight of the animal during inclining of the surface. There has developed a similar need for table tops which at least partially counterbalance the weight of the animal between bifurcated top surfaces which can be independently positioned. There has also developed a need for a veterinary surgical table which can be readily cleaned and from which fluids can be easily collected. Within the context of these needs, there needs to remain a simplicity of design, preferably with a minimum of supporting structure to make movement around the table easy, to facilitate cleaning, and to provide economy of construction.

SUMMARY OF THE INVENTION

These needs have in large measure been met by the veterinary surgical table of the present invention. That is to say, the veterinary surgical table of the present invention provides a counterbalancing force during inclining movement of the table, preferably using self-contained cylinders and rods which require no external power source. In addition, the preferred surgical table presents a bifurcated top to permit tilting of at least one section toward the other, with a counterbalancing member serving to provide a counterbalancing tilt force during movement of the section. Furthermore, the present invention advantageously includes a slidably removable tray positioned beneath a slot defined between the two sections to facilitate removal of liquids falling therein and ease the task of sanitation and cleanup of the top.

The counterbalancing force is advantageously provided by a pressurized fluid cylinder which includes an extensible rod. One fluid cylinder operatively connects the base to the top of the table, whereby the weight of the table top and any animal or other item placed thereon is at least partially compensated by a counterbalancing force. Thus, the veterinarian need not provide all the force for lifting one end of the table or slowing its descent with an animal thereon. By providing a control mechanism which is manually actuatable by one hand, the veterinarian can actuate the pressurized fluid cylinder with one hand and position the top for proper inclination with the other hand.

Advantageously, the pressurized fluid cylinder for inclining the table is mounted along or near a longitudinally bifurcating vertical plane and extending to support the bottom of the table top adjacent the outer margin thereof in a configuration leaving a free outer edge to minimize the framework supporting the top, even when the top is bifurcated into two sections. This reduces interference with the veterinarian as he works around the table top, minimizes the components which must be cleaned, and reduces the cost of materials and assembly.

The present invention also facilitates tilting of separate sections when the top is bifurcated. In this manner, two separate sections can be individually tilted toward the other from a coplanar position to one of less than 180°. A pressurized fluid cylinder is provided for providing counterbalancing tilt force to each section, each preferably with its own manually actuatable control. Each section is supported by a separate pressurized fluid tilt cylinder in a strut-supported manner to minimize the supporting framework. In addition, each pressurized fluid tilt cylinder is connected to a bracket associated with the frame of the table top whereby each section may be independently tilted while the top is in an inclined orientation.

By providing the top in two separate sections, a slot is defined between the inner margins of the bifurcated sections. Fluid accumulating on the surface of each section may then drain to the slot. A slidably removable tray extends the length of the slot and is positioned to collect fluid falling therethrough. A removable receptacle may be carried by the frame at the normally lowermost end thereof when the top is inclined. The receptacle is positioned beneath a hole in the tray positioned adjacent the lowermost end whereby fluid collected in the tray may pass through the hole into the receptacle. The tray is readily removable for cleaning and not only provides approved access to the inner margins of the top sections, but also avoids the necessity of continuous clean-up of a permanently positioned portion of the frame.

These and other advantages of the present invention will be readily understood by those skilled in the art with reference to the accompanied drawing figures and the detailed description.

DESCRIPTION OF THE PREFERRED EMBODIMENT

Figure 1:
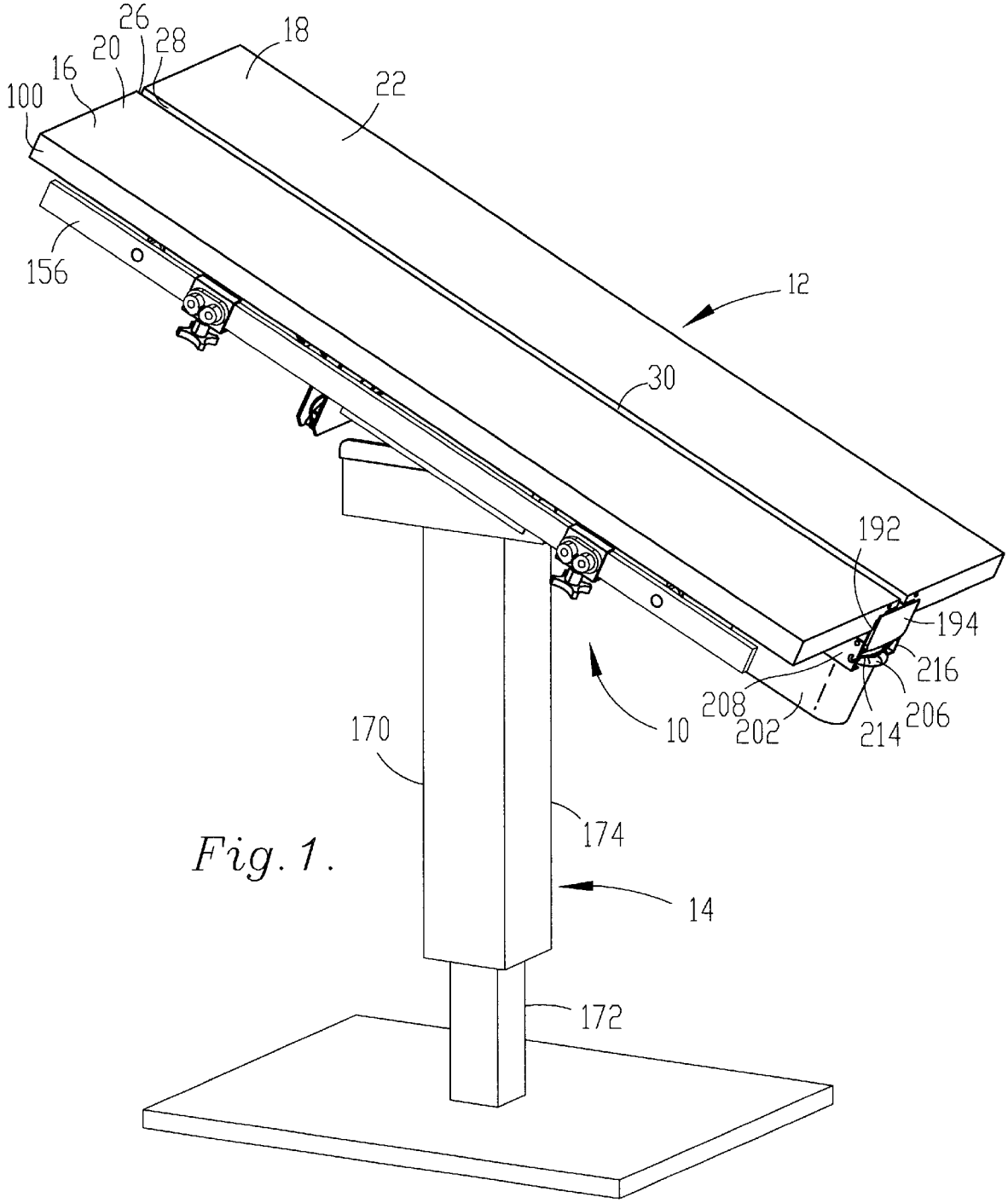
FIG. 1 is a left rear perspective view of a preferred embodiment of the veterinary surgical table hereof, shown in an inclined orientation.
Figures 2, 3:
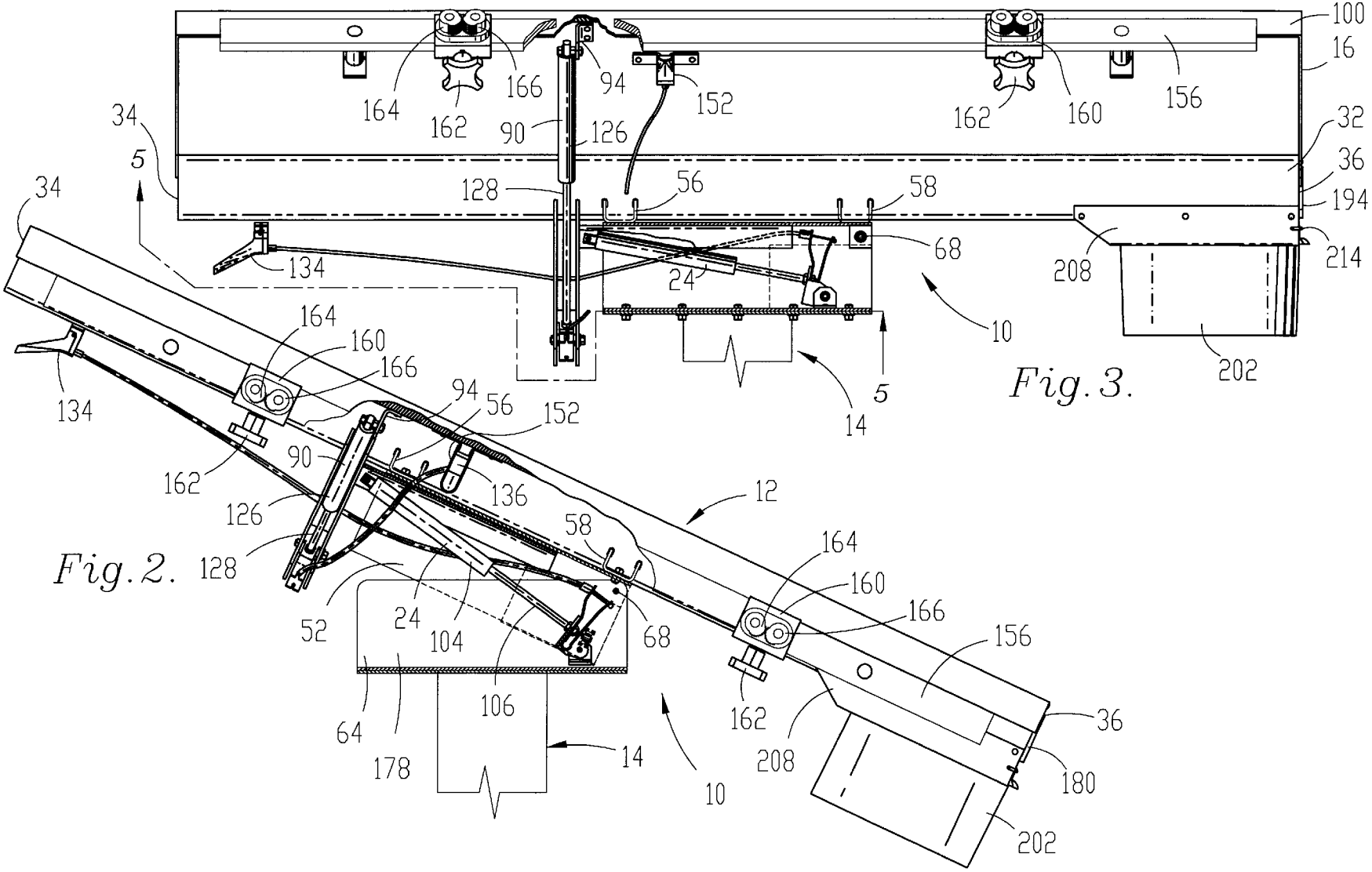
FIG. 2 is a fragmentary left side elevational view in partial cross-section of the veterinary surgical table hereof in an inclined, untilted orientation, with portion of the carrier and top broken away to show the extensible member for inclining the top.
FIG. 3 is a fragmentary left side elevational view in partial cross-section through the tray and portions of the sections of the top similar to FIG. 2, but shown in an uninclined, tilted orientation with one of the tilt rods extended.

Referring now to the drawing, a veterinary surgical table 10 in accordance with the present invention includes top 12 and a base 14 as shown in FIG. 1. The top 12 includes first section 16 and second section 18 each having a respective animal supporting surface 20,22 as shown in FIG. 1. The top 12 is shown in an inclined orientation relative to the base 14 in FIG. 1. As shown in FIG. 2, an extensible number 24 interconnects the base 14 and the top 12 to supply a counterbalancing force during tilting movement of the top 12 relative to the base 14.

In greater detail, each section 16,18 of the top 12 includes a substantially flat surfaces 20,22. Each of the surfaces 20,22 are substantially coplaner when the respective first and second sections 16,18 are in an untilted orientation as shown in FIGS. 1 and 2. Each sections 16,18 presents an inner margins 26,28, respectively. The inner margins 26,28 of the first and second sections 16,18 are spaced apart at least about ⅜ inch to define a longitudinally extending slot 30 therebetween. The slot 30 defines a longitudinal axis of the top 12 which is located intermediate sections 16,18.

Top 12 further includes a longitudinally extending frame 32 oriented substantially parallel to said slot 30, said frame presenting spaced-apart first end 34 and second end 36. Frame 32 includes a pair of C-shaped channels 38,40 best seen in FIGS. 4 and 5. Each channels 38,40 presents a hole 42 proximate to its respective upper, inboard edges 44,46 which has been drilled and tapped to receive a threaded coupling 48 whereby first section 16 is pivotally connected to channel 38 and second section 18 is pivotally connected to said channel 40. As may be seen in FIG. 4, a corresponding opening 50 is provided in each end of each sections 16,18 to receive threaded coupling 48, the opening 50 being positioned outwardly from each inner margins 26,28 whereby the width of slot 30 is increased when the sections 16,18 are in a tilted orientation.

Figure 4:
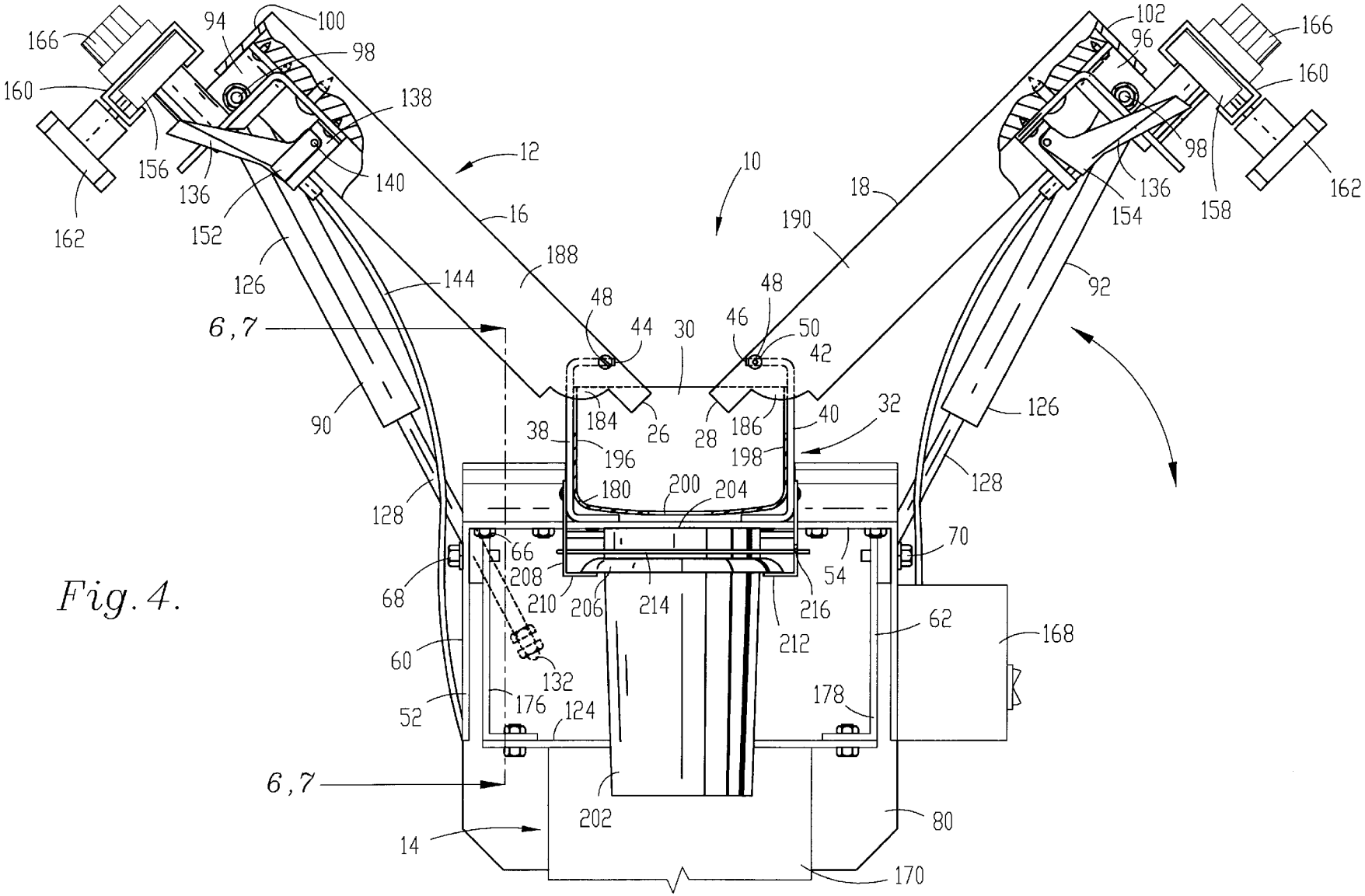
FIG. 4 is a fragmentary rear end elevational view in partial section of the veterinary surgical table hereof, showing the first and second top sections in the tilted orientation shown in FIG. 3.
Figure 6:
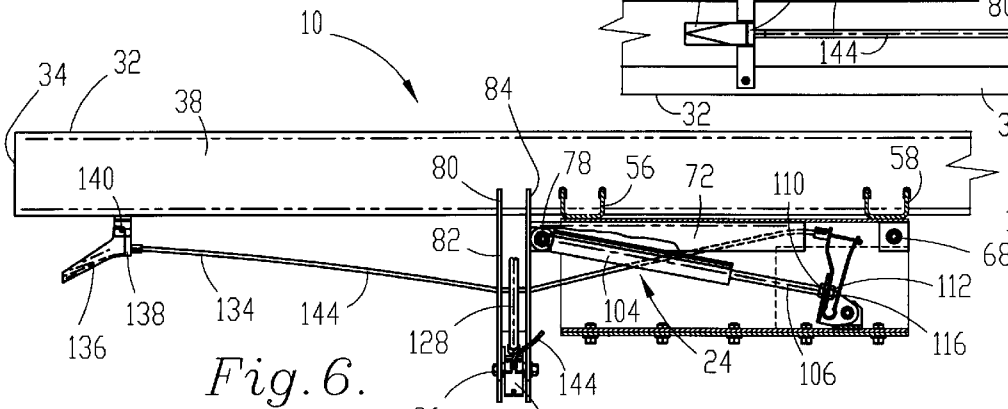
FIG. 6 is a fragmentary vertical cross-sectional view taken along line 6,7—6,7 of FIG. 4, showing the position of the control mechanism connected to the incline cylinder and rod in a substantially flat orientation.

The frame 32 further includes a receiver 52 in the shape of an inverted U presenting an upper bight 54 carrying a pair of transversely oriented supports 56,58. The supports 56,58 have a vinyl cladding along the upper edges thereof to support the top 12 thereon when each of said sections 16,18 are in an untilted orientation as shown in FIG. 2. The receiver 52 further includes a pair of downwardly extending sidewalls 60,62 located outside a carrier 64 as best seen in FIG. 4. The supports 56,58 are bolted to the upper bight 54 by bolts 66 and welded along their inboard edge to channels 38,40 for securing the receiver 52 to the frame 32. The receiver 52 is pivotally connected to carrier 64 by a pair of transversely oriented bolts 68,70 which define therebetween a pivot axis about which the top 12 inclines relative to the base 14. When the top 12 is not in an inclined orientation, as shown in FIGS. 3 and 6, the upper edge of the carrier 64 supports the upper bight 54 of the receiver 52 as shown in FIG. 4. The receiver 52 further includes a guide 72 presenting a pair of spaced-apart downwardly extending rims 74,76 for accommodating the extensible member 24 therebetween. A cross bolt 78 extends between the rims 74,76 and pivotally connects the extensible member 24 thereto.

Figure 5:
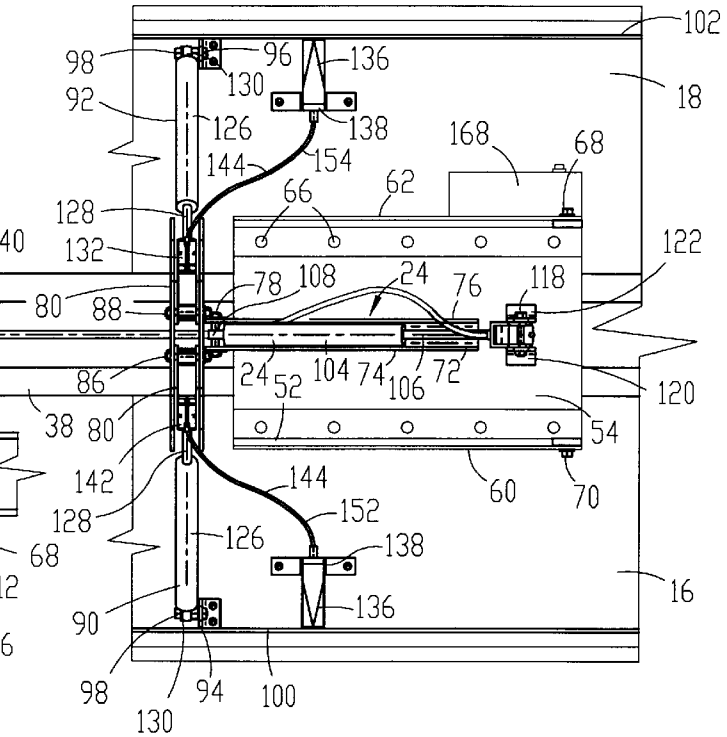
FIG. 5 is a bottom plan view in partial section taken along line 5—5 of FIG. 3 and showing the incline controls and incline cylinder and rod and the tilt controls and extensible tilt member with the carrier positioned atop the pedestal of the based removed for clarity.

A bracket 80 is further included in frame 32 and is positioned forwardly of the guide 72 as shown in FIGS. 5 and 6. The bracket 80 includes a pair of plates 82,84 welded to the channels 38,40 whereby the bracket 80 shifts with the channels 38,40 during inclining movement of the top 12 as illustrated in a comparison of FIGS. 6 and 7. The bracket 80 includes first and second through bolts 86,88 extending between plates 82,84 and pivotally connect the bracket 80 to tilt members 90,92, respectively. Each of said tilt members 90,92 are in turn pivotally coupled to respective first and second mounting flanges 94,96 by bolts 98. Mounting flange 94 is coupled to the underside of section 16 adjacent the outboard margin 100 thereof and preferably, in combination with couplings 48, constitute the sole support for section 16 when in a tilted orientation as shown in FIGS. 3 and 4. Similarly, mounting flange 96 is coupled to the underside of section 18 adjacent the outboard margin 102 thereof, and preferably, in combination with couplings 48 at each end of the section 18, constitute the sole support for section 18 when it is in a tiled orientation.

Extensible member 24 most preferably is provided as a unitary assembly including a pressurized fluid cylinder 104 and an extensible rod 106 carried by the cylinder 104. A commercially available pressurized fluid cylinder and rod assembly useful in connection with this invention as extensible member 24 is sold by Stabilus USA of Colman, Pa. under the trademark BLOC-O-LIFT, Model 2029ET 0800N. The cylinder 104 presents an apperatured ear 108 for receiving cross bolt 78 therethrough as shown in FIG. 5. Extensible rod 106 is threaded at its remote end to receive locking nuts 110,112 thereon with pivot flange 114 secured therebetween. The extensible rod 106 further includes a locking button 116 at the remote end of the rod 106 which, when extended as shown in FIG. 6, locks the rod 106 in position relative to the cylinder 104. The pivot flange 114 is pivotally connected by bolt 118 to pivot brackets 120,122 welded to the floor 124 of carrier 64.

Extensible tilt members 90,92 are similarly preferably provided as a unitary assembly including a pressurized fluid tilt cylinder 126 and extensible tilt rods 128. A commercially available pressurized fluid cylinder and rod assembly useful in connection with this invention as extensible member 24 is sold by Stabilus USA of Colman, Pa. under the trademark BLOC-O-LIFT, Model 1943CR 0200N. Each tilt cylinder 126 includes a coupling ear 130 to permit pivotal movement of the extensible tilt members 90,92 during tilting movement of sections 16,18. Similar to the extensible member 24, the tilt rods 128 each include a locking button 132 at the remote end of the tilt rod 128 which, when the button 132 is extended, locks the tilt rod 128 in position relative to the tilt cylinder 126.

The locking button 116 is controlled by incline control member 134 which includes a manually actuatable toggle lever 136 pivotally connected to carriage 138 by trunnion 140. Toggle lever 136 is operably connected to spring bracket 142 by Bowden cable 144. Spring bracket 142 includes leg 146 having hole through which extensible rod 106 extends and is secured to pivot flange 114 by nuts 110,112. Spring bracket 142 also includes finger 148 which is brought into engage to depress button 116 by the engagement with terminal 150 when toggle lever 136 is actuated.

Each of the extensible tilt members 90,92 are similarly provided with tilt control members 152,154 which are identical in all respects to control member 134 as including toggle lever 136, carriage 138, Bowden cable 144, and spring bracket 142. As in control member 134, when the toggle levers 136 of tilt control members are shifted to pull on the inner cable within Bowden cable 144 as illustrated by toggle lever 136 of tilt control member 154 in FIG. 4, the finger 148 engages the button 132 at the end of the tilt rod 128 to unlock the respective tilt member 90 or 92 and permit tilting movement of the respective section 16,18 and application of the counterbalancing force by the respective tilt cylinder 126.

The top 12 also includes rail 156 mounted adjacent the outboard margin 100 of section 16 and rail 158 mounted adjacent the outboard margin of section 18. Each rail 156, 158 preferably carries a pair of shoes 160 which are slidable therealong and may be secured in position by threadably mounted clamping knobs 162. Each shoe in turn mounts a pair of adjacent cam-shaped cleats 164, 166 which serve to grab therebetween tie-down straps when the cleats pivot into engagement with the strap.

When desired, the top 12 may include a heating element positioned below the surfaces 20, 22. Such a heater may be, for example, an electrical resistance heater well-known to those skilled in the art and supplied with electricity routed through a control box 168 which includes a switch for actuating the heating element.

The base 14 of the veterinary surgical table preferably includes a pedestal 170 including a stationary inner member 172 and an outer member 174 telescopically mounted thereon. The outer member 174 may be translated upwardly by an electrical motor and screw drive which raises the outer member 174 when a switch is actuated. The base 14 also includes carrier 64 whose floor 124 is bolted to the outer member 174 of the pedestal 170. A pair of sidewalls 176 and 178 project upwardly from the floor 124 for supporting the bight 54 of receiver 52 when the top 12 is in an untilted, usually horizontal orientation.

An elongated, preferably plastic tray 180 is positioned beneath the slot 30 and extends substantially the length thereof. The tray 180 is held in place by channels 38 and 40, which are also connected along their bottoms by bar 182 to which carriage 138 is secured. When the sections 16 and 18 are coplaner, the tray 180 may be easily removed by sliding rearwardly along the channels 38 and 40. However, when the sections 16 or 18 are in a tilted orientation, lips 184 and 186 are presented along the rear margin 188, 190 respectively of each section 16, 18 which are received in slits 192 located forwardly of the rear wall 194 of the tray 180 and engage the side panels 196 and 198 of the tray against undesired sliding. The tray is also provided with a hole 200 located just forwardly of rear wall 194 so that liquid collected in the bottom of the tray may flow downwardly into receptacle 202. Receptacle 202 presents an open upper mouth 204 to receive such liquids and includes a circumscribing shoulder 206. A chute 208 is attached to the rear end of the channels 38, 40 which includes inwardly projecting flanges 210, 212 to support the shoulder 206 of the receptacle 202 when inserted beneath the hole 200 of the tray 180. A wire bail 214 extends across the chute 208 at its rearward end to retain the receptacle 202 in position when the top 12 is inclined, as shown in FIG. 1, and may swing out of a retaining slot 216 to swing open and permit removal of the receptacle 202 when desired.

Figure 7:
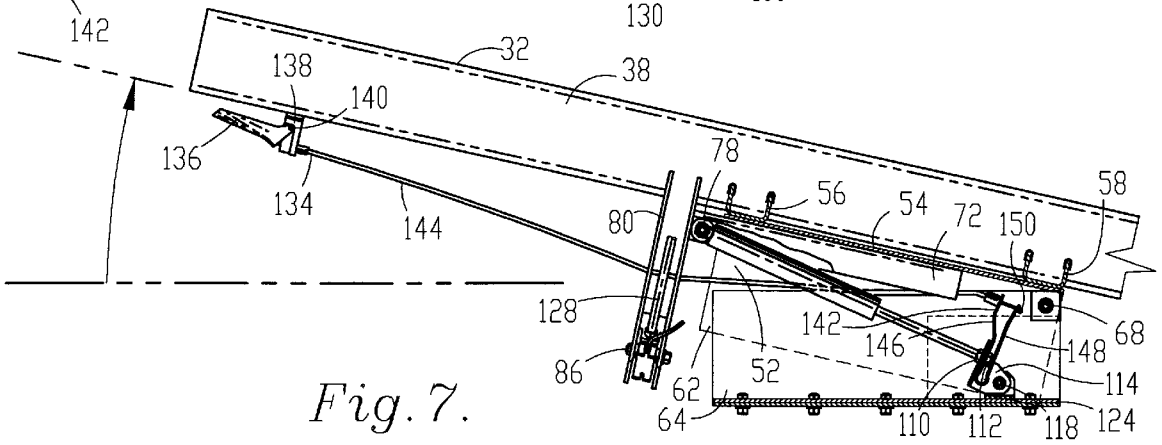
FIG. 7 is a fragmentary vertical cross-sectional view taken along line 6,7—6,7 as in FIG. 6, but showing inclining movement of the top and application of the counterbalancing force when the incline control member is in an actuated position.

The configuration of the present invention makes treatment of the small animal placed thereon easier for the veterinarian. After placement of the animal on the surface of the top 12, the veterinarian extends the pedestal 170 to raise the top 12 to the desired height. The switch on the control box 168 may be actuated to supply heat to the top 12 if desired. The veterinarian then lifts toggle lever 136 which causes the button 116 to be depressed whereby the pressurized cylinder 104 supplies force to the extensible rod 106. If the animal is light, such as a small cat, the counterbalancing force thus supplied is sufficient to overcome the weight of the top and the animal and cause the top 12 to tilt as illustrated by FIG. 7. If a large dog is placed on the top 12, the counterbalancing force applied by the cylinder 104 aids the veterinarian to tilt the front end of the top 12 upwardly. Once in a desired angle of inclination is achieved, the toggle lever 136 is released which permits the spring bracket 142 to disengage from the button 116, thereby locking the extensible member 24 in position to support the top 12. Restraining straps may then be placed over the animal and secured between the cleats of the shoe 156. When the veterinarian has completed examination or treatment of the animal and the top 12 is to be lowered, the toggle lever 136 is again actuated to unlock the extensible member 24 and the counterbalancing force is again supplied to slow the descent of the front of the top 12 during lowering to a substantially horizontal position.

When the top 12 is bifurcated into two sections 16 and 18, the sections may be tilted so that the upper surfaces 20 and 22 may be oriented from a coplanar relationship as shown in FIG. 1 to a tilted orientation as shown in FIG. 4 with each section 16, 18 being independently tiltable about its own respective pivot axis defined by respective couplings 48. When the veterinarian desires to tilt either section 16 or 18, he lifts the toggle lever 136 of the respective tilt control member 152 or 154 to unlock the extensible tilt rod 128 from the pressurized tilt cylinder 126, thereby permitting the respective extensible tilt member 90, 92 to exert a force on the underside of its corresponding section 16, 18. The extensible tilt members 90, 92, like extensible member 24, are self-contained in that no external source of power is necessary to operate the cylinders 126. The force applied by the tilt members 90, 92 serves to offset, at least in part, the weight of the corresponding section and the animal placed thereon. When a section 16, 18 is properly positioned, the toggle lever 136 is released to lock the tilt member in position so that the veterinarian need not hold on to the section to maintain its position. To move the sections back to a flat, coplanar orientation, the toggle lever 136 of each section is again lifted and the veterinarian pushes down on the section until that section is fully depressed and rests on supports 56 and 58. It may be appreciated that the construction presented herewith permits inclination of the top 12 independently of tilting of each section, and that each section 16, 18 may be tilted independently of the other.

The tray 180 may be readily removed by sliding rearwardly along channels 38 and 40. However, when either of the sections 16 or 18 is tilted, the tray 180 is retained against slippage by engagement of the side panels 196 and 198 of the tray with the lips 184 and 186 of the rear margin of each section. Further, bail 214 prevents undesired slippage of the receptacle 202 during. Liquid collecting on surfaces 20, 22 flows into slot 30 and into tray 180 before falling through the hole in the tray 180 to the receptacle 202.

The configuration of the veterinary surgical table 10 facilitates cleaning. By tilting each section 16 and 18, the width of slot 30 is increased as shown in FIG. 4, thereby improving access to the inner margins 26 and 28 of each section. When the two sections 16 and 18 are again coplanar, the tray may be removed by pulling it rearwardly. By moving bail 214 out of retaining slot 216, the receptacle can be removed for proper disposal of any liquid collected therein.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the liberal scope of the invention as set out in the following claims.

I claim:

1. A veterinary surgical table comprising: a top presenting a surface for supporting an animal thereon; a base for elevating the top, said base including means for mounting said top for shiftable movement between a substantially horizontal position and an inclined position and a plurality of intermediate positions therebetween; and means including an extensible member and force-supplying means operatively connecting said base and said top for supplying a force for counterbalancing the weight of the top during shifting movement thereof, said extensible member and force supplying means including a self-contained pressurized fluid cylinder coupled to an extensible rod wherein said pressurized fluid cylinder and extensible rod are coupled to said base for support of said top, said table further including a control member including a locking member for releasably locking said top in a selected one of said positions.

2. A veterinary surgical table as set forth in claim 1, wherein said base includes a pedestal and a carrier mounted on said pedestal, said carrier including a pivot member for pivotal movement of said top relative to said base.

3. A veterinary surgical table as set forth in claim 2, wherein said top presents a longitudinal axis, said top being bifurcated along said longitudinal axis into first and second sections.

4. A veterinary surgical table as set forth in claim 3, said top including a frame oriented substantially parallel to said longitudinal axis, said frame presenting first and second spaced-apart ends and including a coupling adjacent each end for enabling tilting movement of at least one of said first and second sections toward the other said section whereby the angle between the surface of said sections may be less than 180°.

5. A veterinary surgical table as set forth in claim 4, said frame including a pair of coupling members adjacent each end for enabling tilting of both said first and second sections about tilt axes substantially parallel to one another and to said longitudinal axis.

6. A veterinary surgical table comprising:

a top presenting a first section and an adjacent second section, each of said first and second sections presenting respective first and second upper surfaces;

a base supporting said top thereon;

a frame operatively connected to said top and each of said first and second sections, said frame including coupling members connected to said first and second sections enabling tiltable movement of each of said sections toward the other whereby the angle between said upper surfaces may be less than 180°;

first and second extensible tilt members interconnecting said frame and said first and second sections respectively, said first and second extensible tilt members each including a self-contained pressurized fluid cylinder and an extensible rod for supplying counterbalancing force to said respective sections during tilting movement, said table including manually actuatable first and second tilt controls, each of said tilt controls being shiftable between an actuating position for permitting relative shiftable movement between one of said respective cylinders and its corresponding extensible rod and application of the counterbalancing force to a respective one of said sections, and a locking position for retaining said extensible rod against shifting movement relative to said cylinder to thereby prevent tilting movement of the respective one of said sections.

7. A veterinary surgical table comprising:

a top presenting adjacent first and second sections having respective first and second inner margins defining a longitudinally extending slot therebetween;

a frame located beneath said top in supporting relationship thereto; and a tray slidably received by said frame, said tray extending substantially the length of said slot and oriented to receive liquids received in said slot.

8. A veterinary surgical table as set forth in claim 7, said tray including an opening therein, and including a receptacle removably mounted on said frame adjacent said opening.

9. A veterinary surgical table comprising:

a top presenting a surface for supporting an animal thereon;

a base for elevating the top, said base including means for mounting said top for shiftable movement between a substantially horizontal position and an inclined orientation; and means including an extensible member and force-supplying means operatively connecting said base and said top for supplying a force for counterbalancing the weight of the top during shifting movement thereof, wherein said extensible member and force supplying means includes a self-contained pressurized fluid cylinder coupled to an extensible rod and wherein said pressurized fluid cylinder and extensible rod are coupled to said base for support of said top, said table including a control member operatively connected to said pressurized fluid cylinder for selective application of force from said pressurized cylinder to said extensible rod and wherein said control member includes a locking member for inhibiting shiftable movement of said rod relative to said cylinder, wherein said base includes a pedestal and a carrier mounted on said pedestal, said carrier including a pivot member for pivotal movement of said top relative to said base, wherein said top presents a longitudinal axis, said top being bifurcated along said longitudinal axis into first and second sections, said top including a frame oriented substantially parallel to said longitudinal axis, said frame presenting first and second spaced-apart ends and including a coupling adjacent each end for enabling tilting movement of at least one of said first and second sections toward the other said section whereby the angle between the surface of said sections may be less than 180°, said frame including a pair of coupling members adjacent each end for enabling tilting of both said first and second sections about tilt axes substantially parallel to one another and to said longitudinal axis, said frame including a bracket, and including first and second extensible tilt members interconnecting said bracket and said first and second sections respectively.

10. A veterinary surgical table as set forth in claim 9, wherein said first and second extensible tilt members include respective first and second pressurized tilt cylinders having respective first and second tilt rods, said first tilt cylinder and first tilt rod operatively connecting said first section and said bracket for supplying a counterbalancing force to said first section when in a tilted orientation, said second tilt cylinder and said second tilt rod operatively connecting said second section and said bracket for supplying a counterbalancing force to said second section when in a tilted orientation.

11. A veterinary surgical table as set forth in claim 10, said first tilt cylinder and said first tilt rod being coupled to a first tilt control member for selective application of force from said first tilt cylinder to said first tilt rod.

12. A veterinary surgical table as set forth in claim 11, wherein said first tilt control member includes a locking member for inhibiting shiftable movement of said first tilt rod relative to said first tilt cylinder.

13. A veterinary surgical table as set forth in claim 12, said second tilt cylinder and said second tilt rod being coupled to a second tilt control member for selective application of force from said second tilt cylinder to said second tilt rod.

14. A veterinary surgical table as set forth in claim 13, wherein said second tilt control member includes a locking member for inhibiting shiftable movement of said second tilt rod relative to said second tilt cylinder.

15. A veterinary surgical table comprising:

a top presenting a surface for supporting an animal thereon;

a base for elevating the top, said base including means for mounting said top for shiftable movement between a substantially horizontal position and an inclined orientation; and means including an extensible member and force-supplying means operatively connecting said base and said top for supplying a force for counterbalancing the weight of the top during shifting movement thereof, wherein said extensible member and force supplying means includes a self-contained pressurized fluid cylinder coupled to an extensible rod and wherein said pressurized fluid cylinder and extensible rod are coupled to said base for support of said top, said table including a control member operatively connected to said pressurized fluid cylinder for selective application of force from said pressurized cylinder to said extensible rod and wherein said control member includes a locking member for inhibiting shiftable movement of said rod relative to said cylinder, wherein said base includes a pedestal and a carrier mounted on said pedestal, said carrier including a pivot member for pivotal movement of said top relative to said base, wherein said top presents a longitudinal axis, said top being bifurcated along said longitudinal axis into first and second sections, said top including a frame oriented substantially parallel to said longitudinal axis, said frame presenting first and second spaced-apart ends and including a coupling adjacent each end for enabling tilting movement of at least one of said first and second sections toward the other said section whereby the angle between the surface of said sections may be less than 180°, said first and second sections presenting a slot therebetween, and including a tray carried by said frame for sliding movement therealong.

16. A veterinary surgical table as set forth in claim 15, said tray including an opening therein, and including a receptacle removably mounted on said frame adjacent said opening.

17. A veterinary surgical table comprising:

a top presenting a first section and an adjacent second section, each of said first and second sections presenting a respective first and second upper surfaces;

a base supporting said top thereon;

a frame mounted on said base;

first and second coupling members defining respective first and second pivot axes, said first coupling members pivotally connecting said first section to said frame for pivoting about said first pivot axes, said second coupling members pivotally connecting said second section to said frame for pivoting about said second pivot axes whereby the angle between said upper surfaces may be less than 180°;

first and second extensible tilt members for providing a pivoting force to respective ones of said first and second sections outboard of said pivot axes for urging the upper surfaces of said sections to an angle less than 180° during movement of said first and second sections respectively about said first and second pivot axes, said extensible tilt members each including a self-contained pressurized fluid cylinder and an extensible rod for supplying counterbalancing force to said respective sections during tilting movement about said pivot axes.

18. A veterinary surgical table as set forth in claim 17, including manually actuatable first and second tilt controls, each of said tilt controls being shiftable between an actuating position for permitting relative shiftable movement between one of said respective cylinders and its corresponding extensible rod and application of the counterbalancing force to a respective one of said sections, and a locking position for retaining said extensible rod against shifting movement relative to said cylinder to thereby prevent tilting movement of the respective one of said sections.

* * * * *